US009206793B2

(12) United States Patent
Lee

(10) Patent No.: US 9,206,793 B2
(45) Date of Patent: Dec. 8, 2015

(54) APPARATUS AND METHOD FOR GENERATING AIR PRESSURE IN ECO-FRIENDLY VEHICLE

(71) Applicants: Hyundai Motor Company, Seoul (KR); Kia Motors Corporation, Seoul (KR)

(72) Inventor: Sanghyu Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 305 days.

(21) Appl. No.: 13/688,322

(22) Filed: Nov. 29, 2012

(65) Prior Publication Data

US 2014/0079562 A1 Mar. 20, 2014

(30) Foreign Application Priority Data

Sep. 19, 2012 (KR) ..... 10-2012-0104000

(51) Int. Cl.

| | |
|---|---|
| ***F04B 17/05*** | (2006.01) |
| ***F04B 35/00*** | (2006.01) |
| ***F04B 35/04*** | (2006.01) |
| ***F04B 41/06*** | (2006.01) |

(52) U.S. Cl.

CPC ..... *F04B 17/05* (2013.01); *F04B 35/002* (2013.01); *F04B 35/04* (2013.01); *F04B 41/06* (2013.01)

(58) Field of Classification Search

CPC ..... F04B 17/05; F04B 35/002; F04B 35/04; F04B 41/02; F04B 41/06; F04B 49/08; F04B 49/02; F04B 49/022; F04B 49/06; F04B 2203/0202; F04B 2203/06; F04B 2205/05; F04B 2205/06; F04B 2205/063

USPC ..... 417/53

See application file for complete search history.

(56) References Cited

U.S. PATENT DOCUMENTS

| | | | | |
|---|---|---|---|---|
| 3,765,180 | A * | 10/1973 | Brown | 60/370 |
| 6,651,450 | B1 * | 11/2003 | Tamegai et al. | 62/133 |
| 2004/0055305 | A1 * | 3/2004 | Kuroda et al. | 60/698 |
| 2004/0151606 | A1 | 8/2004 | Doerr et al. | |
| 2004/0237517 | A1 * | 12/2004 | Cho et al. | 60/370 |
| 2009/0175742 | A1 * | 7/2009 | Grethel et al. | 417/364 |
| 2009/0254246 | A1 * | 10/2009 | Yang et al. | 701/36 |
| 2011/0231047 | A1 * | 9/2011 | Aixala et al. | 701/22 |

FOREIGN PATENT DOCUMENTS

| | | |
|---|---|---|
| JP | 2004-084484 A | 3/2004 |
| JP | 2005-039885 A | 2/2005 |

(Continued)

*Primary Examiner* — Justin Jonaitis
*Assistant Examiner* — Stephen Mick
(74) *Attorney, Agent, or Firm* — Mintz Levin Cohn Ferris Glovsky and Popeo, P.C.; Peter F. Corless

(57) ABSTRACT

Disclosed herein is an apparatus for generating air pressure in an eco-friendly vehicle that includes an engine driven air compressor operated by an engine, an electric air compressor operated by a battery, and an air tank connected to an outlet of the engine driven air compressor and to an outlet of the electric air compressor so as to store air which is pressurized. A method for generating air pressure in an eco-friendly vehicle includes an operation start air pressure determination step to compare air pressure in the air tank with operation start air pressure, an engine drive determination step to determine whether or not the engine is being operated when the air pressure is less than the operation start air pressure, an electric air compressor operation step to operate the electric air compressor, and an engine driven air compressor operation step to operate the engine driven air compressor accordingly.

6 Claims, 2 Drawing Sheets

(56) References Cited

FOREIGN PATENT DOCUMENTS

| | | | |
|---|---|---|---|
| JP | 2010-236711 | A | 10/2010 |
| KR | 200189847 | Y1 | 7/2000 |
| KR | 20050110534 | A | 11/2005 |
| KR | 20070088262 | A | 8/2007 |
| KR | 20100115643 | A | 10/2010 |
| WO | WO-95/22474 | A1 | 8/1995 |

* cited by examiner

APPARATUS AND METHOD FOR GENERATING AIR PRESSURE IN ECO-FRIENDLY VEHICLE

CROSS-REFERENCE TO RELATED APPLICATIONS

This application claims priority to Korean Patent Application No. 10-2012-0104000, filed on Sep. 19, 2012, which is incorporated herein by reference in its entirety.

BACKGROUND OF THE INVENTION

1. Field of the Invention

The present invention relates to an apparatus and a method for generating air pressure in an eco-friendly vehicle; and, particularly, to an apparatus and a method for generating air pressure in an eco-friendly vehicle that is configured to allow an engine driven air compressor and an electric air compressor to be optionally or alternately operated depending on a traveling state of a vehicle and whether or not a voltage system is operating normally in an eco-friendly vehicle equipped with an engine and a high voltage battery.

2. Description of Related Art

Often times a vehicle, particularly a commercial vehicle such as a bus, a truck, or a special purpose vehicle, is mounted with an air compressor which is operated by an engine, to provide air pressure required for operation of additional auxiliary devices in the vehicle.

In the vehicle driven by an engine as described above, since the engine is always driven during traveling of the vehicle, the air compressor can only be operated when the engine is currently being operated. In recent years, however, eco-friendly vehicles have begun to emerge in which the engine is not always running, such as a hybrid vehicle. In hybrid vehicles, the vehicle is provided power from both an engine and an electric motor.

As more and more research is conducted on hybrid vehicles, the running time of the engine continually decreases whereas operating time of the motor increases, due to development in technologies for a battery and charging thereof. Also, given the development of plug-in hybrid vehicles, vehicles are becoming even less dependent upon the engine to provide a drive force. Accordingly, a phenomenon has occurred in which air pressure which is required by a variety of devices of the vehicle has decreased due to reductions in operating times of an engine.

Since a decrease of air pressure causes limitations on operations of a variety of special devices including the brakes and the suspension, which are necessary component in order to operate the vehicle, the engine is often operated merely to provide air pressure to these components even when operation of the motor alone would suffice.

Such a problem is also an issue even in an RE-EV (Range Extended Electric Vehicle) equipped with a charging-dedicated engine to increase a traveling range while being operated by electric power charged to mainly a high voltage battery among electric vehicles, besides the hybrid vehicle.

SUMMARY OF THE INVENTION

An exemplary embodiment of the present invention is directed to an apparatus and a method for generating air pressure in an eco-friendly vehicle having installed an engine driven air compressor operated by an engine and an electric air compressor operated by a motor, and allowing the engine driven air compressor and the electric air compressor to be optionally/alternatively operated depending on a traveling condition of a vehicle, thereby enhancing fuel efficiency of the vehicle together with reducing a drive time of the engine conventionally necessary to generate air pressure.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an exemplary embodiment of the present invention, an apparatus for generating air pressure in an eco-friendly vehicle includes an engine driven air compressor configured to be operated by an engine, an electric air compressor configured to be operated by a battery, and an air tank configured to be connected to an outlet of the engine driven air compressor and to an outlet of the electric air compressor to store air pressurized generated by the engine driven air compressor and the electric air compressor, wherein the engine driven air compressor is operated when the engine is driven, and wherein the electric air compressor is operated when the engine is not being driven.

The apparatus for generating air pressure in an eco-friendly vehicle may further include check valves configured to be respectively provided at an outlet side of the engine driven air compressor and at an outlet side of the electric air compressor to control the air pressurized by the engine driven air compressor or the electric air compressor supplied to the air tank.

In accordance with another exemplary embodiment of the present invention, a method for generating air pressure in an eco-friendly vehicle includes determining operation start air pressure to compare air pressure in an air tank with operation start air pressure which is configured so that an engine driven air compressor or an electric air compressor is operated, determining engine drive to determine whether or not an engine mounted to a vehicle is driven when the air pressure in the air tank is less than the operation start air pressure, operating the electric air compressor when the engine is not being driven at the determining engine drive, operating the engine driven air compressor when the engine is being driven at the determining engine drive, and determining operation completion air pressure to compare the air pressure in the air tank with operation completion air pressure which is configured so that an operation of the engine driven air compressor or the electric air compressor is stopped after operating the electric air compressor or the operating the engine driven air compressor accordingly.

The method for generating air pressure in an eco-friendly vehicle may further include determining an electric air compressor error to determine whether or not the electric air compressor is operating normally after determining that the engine is not being driven, wherein the electric air compressor may be operated when the electric air compressor is operating normally, and the engine driven air compressor may be operated when the electric air compressor is operating abnormally.

The method for generating air pressure in an eco-friendly vehicle of the exemplary embodiment of the present invention may further include determining a high voltage system error to determine whether or not a high voltage system of the vehicle is normally operating once the electric air compressor is determined as being normally operating. More specifically, the electric air compressor may be operated when the high voltage system is operating normally, and the engine driven air compressor may be operated when the high voltage system is operating abnormally.

The method for generating air pressure in an eco-friendly vehicle of the exemplary embodiment of the present invention may further include determining a low voltage system error to determine whether or not a low voltage system of the vehicle is operating normally when the high voltage system is determined as being operated normally. More specifically, the electric air compressor may be operated when the low voltage system is operating normally, and the operating the engine driven air compressor may be executed when the low voltage system is operating abnormally.

The operation of the engine driven air compressor or the electric air compressor may be stopped when the air pressure in the air tank is equal to or greater than an operation completion air pressure; and the process may return to the determining whether the engine is being driven when the air pressure in the air tank is less than the operation completion air pressure.

Additionally, the operation completion air pressure may be configured to be higher than the operation start air pressure.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DESCRIPTION OF SPECIFIC EMBODIMENTS

Figure 1:
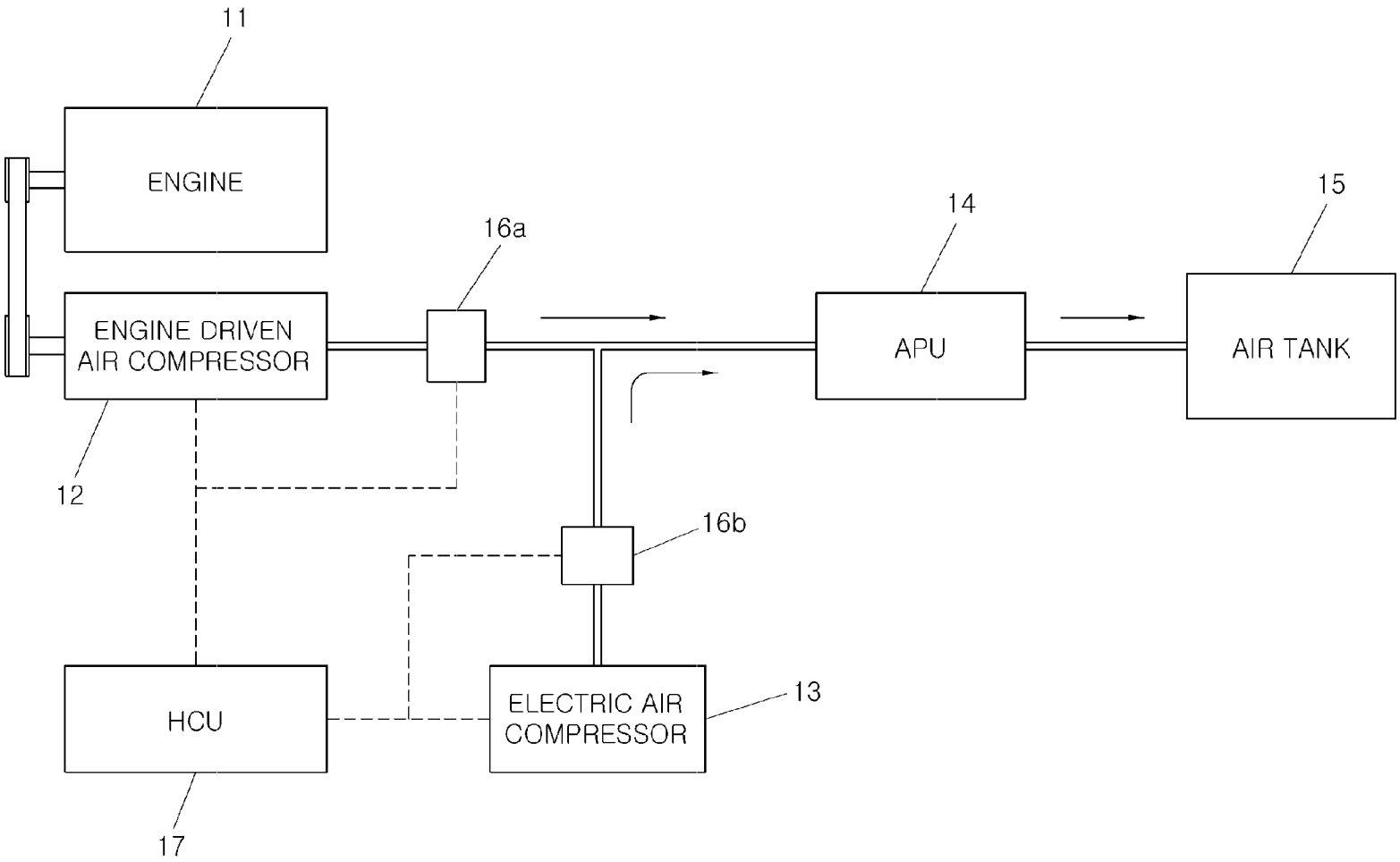
FIG. 1 is a block diagram illustrating an apparatus for generating air pressure in an eco-friendly vehicle in accordance with an exemplary embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles and plug-in hybrid electric vehicles, and other vehicles which include both an engine and a motor to power the vehicle. As referred to herein, a hybrid vehicle is a vehicle that has two or more sources of power, for example both gasoline-powered and electric-powered vehicles.

Additionally, it is understood that the below methods are executed by at least one controller. The term controller refers to a hardware device that includes a memory and a processor. The memory is configured to store the modules and the processor is specifically configured to execute said modules to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Hereinafter, an apparatus for generating air pressure in an eco-friendly vehicle in accordance with an exemplary embodiment of the present invention will be described in more detail with reference to the accompanying drawings.

The apparatus for generating air pressure in an eco-friendly vehicle in accordance with an embodiment of the present invention includes an engine driven air compressor 12 operated by an engine 11, an electric air compressor 13 which is operated independently of the engine driven air compressor 12 and is operated by a battery mounted in the vehicle, an air tank 15 to store air pressurized by the engine driven air compressor 12 and the electric air compressor 13, and check valves 16*a* and 16*b* which are installed on outlet sides of the respective engine driven air compressor 12 and electric air compressor 13.

The engine driven air compressor 12 is operated by the engine 11 to generate air pressure required by components installed in the vehicle. An air compressor installed in a typical vehicle may be utilized as the engine driven air compressor 12. The engine driven air compressor 12 is mechanically connected to the engine 11. Accordingly, when the engine 11 is operated, the engine driven air compressor 12 is operated by the engine 11 and discharges the pressurized air.

Unlike the engine driven air compressor 12, the electric air compressor 13 is operated by electric power supplied from the battery independently of operation of the engine 11 so as to generate the air pressure. That is, since the electric air compressor 13 is operated regardless of the operation of the engine 11, the electric air compressor 13 may generate the air pressure required for operations of a variety of components within the vehicle by discharging the pressurized air even while the engine 11 is not being operated.

The air tank 15 stores the pressurized air which is supplied from the engine driven air compressor 12 and the electric air compressor 13. The air tank 15 is connected to the engine driven air compressor 12 and the electric air compressor 13 through pipes, thereby allowing the air pressurized by the engine driven air compressor 12 and the electric air compressor 13 to be introduced into the air tank 15. That is, the pipes, which are connected to the outlet sides of the respective engine driven air compressor 12 and electric air compressor 13, are joined to each other and connected to the air tank 15.

In this case, the check valves 16*a* and 16*b* are provided at the outlets of the engine driven air compressor 12 and the electric air compressor 13, respectively, in order to optionally/alternatively transfer the pressurized air to the air tank 15. That is, the check valve 16*a* is provided at the outlet side of the engine driven air compressor 12, whereas the check valve 16*b* is provided at the outlet side of the electric air compressor 13. The check valve 16*a* which is connected to the engine driven air compressor 12 is opened so that the engine driven air compressor 12 communicates with the air tank 15 during discharge of the pressurized air by an operation of the engine driven air compressor 12. On the other hand, the check valve 16*b* which is connected to the electric air compressor 13 is opened so that the electric air compressor 13 communicates with the air tank 15 during an operation of the electric air compressor 13, resulting in pressurized air being collected in the air tank 15 so as to maintain a proper air pressure.

The check valves 16*a* and 16*b* are opened when a pressure is equal to or greater than a preset value is applied. Thus, each of the check valves 16*a* and 16*b* may be provided to be mechanically opened when the engine driven air compressor 12 or the electric air compressor 13 is operated.

In addition, the check valve 16*a* or 16*b* may also be opened by a controller, for example, an HCU (Hybrid Control Unit) 17 when the engine driven air compressor 12 or the electric air compressor 13 is operated.

Meanwhile, the air tank 15 may be provided, at a front end thereof, with an APU (Air Pressure Unit) 14 to remove moisture contained in the pressurized air which is introduced into the air tank 15. Furthermore, the APU 14 also may be configured to adjust a pressure of and remove impurities from the pressurized air, in addition to removing the moisture of the pressurized air.

The engine driven air compressor 12, the electric air compressor 13, and the check valves 16*a* and 16*b* may all be controlled by a controller installed in the vehicle. The controller controls operation of the engine driven air compressor 12 and the electric air compressor 13 based on the current operational state of the vehicle (i.e., whether or not engine is being operated or not, whether the battery is operating normally, etc.).

For example, the HCU 17 may be utilized as the controller in the illustrative embodiment of the present invention. The HCU 17 may be configured to allow the operation of the engine driven air compressor 12 or the electric air compressor 13 based on the current operational state of the vehicle by executing one more continuously running processes embedded as logic and executed by a processor.

Hereinafter, a method for generating air pressure in an eco-friendly vehicle in accordance with an embodiment of the present invention will be described in more detail with reference to the accompanying drawings.

The method for generating air pressure in an eco-friendly vehicle in accordance with an exemplary embodiment of the present invention includes an operation start air pressure determination step S110 that compares air pressure in the air tank 15 with operation start air pressure which is set so that the engine driven air compressor 12 or the electric air compressor 13 is operated accordingly. An engine drive determination step S120 determines whether or not the engine 11 mounted within the vehicle is currently being driven when the air pressure in the air tank 15 is less than the operation start air pressure. Then an electric air compressor operation step S160 operates the electric air compressor 13 when the engine 11 is not being driven/operated, and an engine driven air compressor operation step S170 operates the engine driven air compressor 12 when the engine 11 is being driven/operated. Next, an operation completion air pressure determination step S180 compares the air pressure in the air tank 15 with operation completion air pressure which is set so that an operation of the engine driven air compressor 12 or the electric air compressor 13 is stopped after executing the electric air compressor operation step S160 or the engine driven air compressor operation step S170.

During the operation start air pressure determination step S110, the air pressure in the air tank 15 is compared with the operation start air pressure which is set so that the engine driven air compressor 12 or the electric air compressor 13 are operated as a result of the air pressure in the tank falling below a certain value. If the air pressure in the air tank 15 measured at the operation start air pressure determination step S110 is less than the operation start air pressure, the air pressure to operate the various devices of the vehicle would be insufficient. Accordingly, since the air pressure in the air tank 15 should be increased by supply of the pressurized air into the air tank 15, the processes described below are executed to operate the engine driven air compressor 12 or the electric air compressor 13. When, however, the air pressure in the air tank 15 measured at the operation start air pressure determination step S110 is equal to or greater than the operation start air pressure, there is no need to supply the air into the air tank 15. Therefore, the process is not initiated.

The engine drive determination step S120 determines whether or not the engine 11 is being operated in order to determine whether the engine driven air compressor 12 or the electric air compressor 13 should be operated. That is, when the engine 11 is being operated, the air pressure is generated using power of the engine 11, whereas when the engine 11 is not being driven, the air pressure is generated using electric power charged to the battery instead of the engine 11. Therefore, the electric air compressor operation step S160 and the engine driven air compressor operation step S170 to be described later are optionally/alternatively executed depending on whether or not the engine 11 is being operated or not.

The electric air compressor operation step S160 is executed when the engine 11 is not currently being operated. In a state where the engine 11 is not being operated, the electric air compressor 13 is operated using the electric power supplied from the battery of the vehicle. Thus, the air pressure is generated by the electric air compressor 13 even while engine 11 is not operating.

Figure 2:
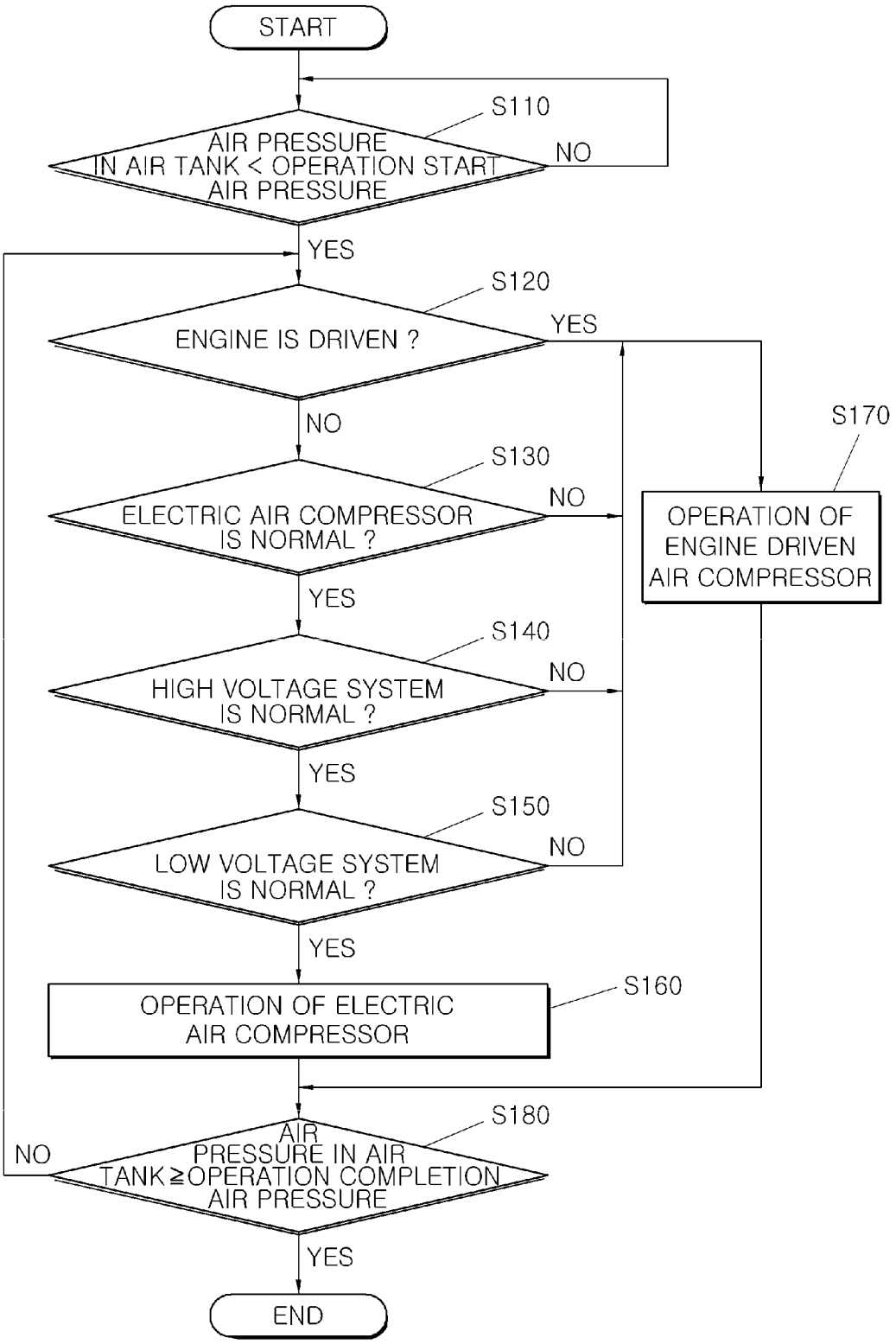
FIG. 2 is a flow chart illustrating a method for generating air pressure in an eco-friendly vehicle in accordance with an exemplary embodiment of the present invention.

Furthermore, in some exemplary embodiments of the present invention it may be preferable to ascertain whether or not a state of the electric air compressor 13 and high and low voltage system of the vehicle are operating normally before operating the electric air compressor 13 at the electric air compressor operation step S160. That is, as shown in FIG. 2, an electric air compressor error determination step S130, a high voltage system error determination step S140, and a low voltage system error determination step S150 may be executed between the engine drive determination step S120 and the electric air compressor operation step S160.

In particular, the electric air compressor error determination step S130 determines whether or not the electric air compressor 13 is operating normally before operating the electric air compressor 13 mounted to the vehicle. The air pressure in the air tank 15 is generated through the electric air compressor 13 only when the electric air compressor 13 is a operating normally state based on the determined state of the electric air compressor 13.

When the electric air compressor 13 is determined as being in an abnormal operational state, the air pressure in the air tank 15 can not be increased via the electric air compressor 13. Therefore, the engine driven air compressor operation step S170 to be described later is executed to operate the engine driven air compressor 12.

The high voltage system error determination step S140 determines whether or not the high voltage system of the vehicle is operating normally, which is used to supply an electric source to a motor used for the drive of the vehicle. That is, it is determined whether or not the high voltage system, for example, a high voltage battery, a high voltage battery managing system, an LDC (Low DC/DC Converter), an inverter, or the like, which supplies the electric source to the motor used for the traveling of the vehicle in the eco-friendly vehicle is operating normally. The electric air compressor 13 is operated via a high voltage so normal operation of these systems is quintessential. Accordingly, when the electric air compressor 13 is to be operated while the engine 11 is not running, there is a limitation on the amount of time the electric air compressor 13 can be operated effectively without over utilizing the power from the battery. Accordingly, the operation time of the electric air compressor 13 may be sufficiently secured by determining whether or not the high voltage system is operating normally.

If the high voltage system is determined to be operating normally at the high voltage system error determination step S140, the process to operate the electric air compressor 13 is continually performed. When the high voltage system is determined to be operating abnormally at the high voltage system error determination step S140, the engine driven air compressor operation step S170 is executed because it is difficult to operate the electric air compressor 13 under these conditions.

The low voltage system error determination step S150 determines whether or not the low voltage system of the vehicle is operating normally. Here, the low voltage system represents an electric system of the typical vehicle driven only by the engine, and is understood to include the entire electrical system except for the high voltage system.

The electric air compressor 13 may be operated when the low voltage system is determined as being operating normally at the low voltage system error determination step S150. However, if the low voltage system is operating abnormally, the engine driven air compressor operation step S170 is executed since the electric air compressor 13 should not be operated under these conditions.

The engine driven air compressor operation step S170 is executed when the engine 11 is determined as being driven at the engine drive determination step S120. Moreover, the engine driven air compressor operation step S170 is executed when the electric air compressor 13 is determined as being operating abnormally at the electric air compressor error determination step S130, the high voltage system of the vehicle is determined as being operating abnormally at the high voltage system error determination step S140, or the low voltage system of the vehicle is determined as being operating abnormally at the low voltage system error determination step S150. In this step 170, the engine may either be turned back on to supply power to the engine driven air compressor or the process may wait until the engine is operating again in due course to supply the air to the pressurized air tank. However, it is preferable that the engine be turned back on instantaneously.

At the engine driven air compressor operation step S170, the engine driven air compressor 12 is operated using the power from the engine 11 which is being driven, thereby generating the air pressure using a portion of the power drawn from the engine 11 which is being driven without using the electric power provided from the battery.

The operation completion air pressure determination step S180 determines whether or not there is sufficient the air pressure in the air tank 15 which is increased depending on the operations of the electric air compressor 13 and the engine driven air compressor 12. When the air pressure in the air tank 15 is sufficient, the operation of the electric air compressor 13 or the engine driven air compressor 12 is stopped. On the other hand, when the air pressure in the air tank 15 is insufficient, it ascertains whether or not the air pressure in the air tank 15 is sufficient since the electric air compressor 13 or the engine driven air compressor 12 should be continually operated so that the air pressure in the air tank 15 is sufficiently increased.

At the operation completion air pressure determination step S180, the air pressure in the air tank 15 is compared with the operation completion air pressure which is set so that the operation of the electric air compressor 13 or the engine driven air compressor 12 is stopped. When the air pressure in the air tank 15 is equal to or greater than the operation completion air pressure, the operation of the electric air compressor 13 or the engine driven air compressor 12 is stopped because the air pressure in the air tank 15 is sufficiently increased. Since the air pressure in the air tank 15 is already sufficiently pressurized to stably operate the various devices of the vehicle, the operation of the electric air compressor 13 or the engine driven air compressor 12 is terminated because the air pressure in the air tank 15 need not be increased any more.

On the other hand, when the air pressure in the air tank 15 is less than the operation completion air pressure, the operation of the electric air compressor 13 or the engine driven air compressor 12 is continually operated since the air pressure in the air tank 15 insufficiently pressurized. That is, when the air pressure in the air tank 15 is less than the operation completion air pressure, the process returns to the engine drive determination step S120 and the above-mentioned processes are repeated so that the electric air compressor 13 or the engine driven air compressor 12 is operated to increase the air pressure in the air tank 15.

In this case, the operation completion air pressure is set to be higher than the operation start air pressure, thereby maintaining the air pressure in the air tank 15 between the operation start air pressure and the operation completion air pressure.

In accordance with an apparatus and a method for generating air pressure in an eco-friendly vehicle according to the exemplary embodiments of the present invention, an engine driven air compressor and an electric air compressor are optionally/alternatively operated depending on a traveling state of a vehicle and whether or not a high voltage system and a low voltage system are operating normally, and thus does not unnecessarily operate an engine in order to merely operate the engine driven air compressor due to a decrease in air pressure unless absolutely necessary.

In addition, since the engine can be run less, fuel efficiency of the vehicle may be enhanced. Furthermore, since the air pressure of the vehicle may be always maintained above a certain level, a variety of devices of the vehicle may be stably operated.

While the present invention has been described with respect to the specific embodiments, it will be apparent to those skilled in the art that various changes and modifications may be made without departing from the spirit and scope of the invention as defined in the following claims.

What is claimed is:

1. A method for generating air pressure in an eco-friendly vehicle, comprising:

comparing, by a controller, an air pressure in an air tank with an operation start air pressure;

in response to determining that the air pressure in the air tank is less than the operation start air pressure, determining, by the controller, whether an engine is being operated or not;

in response to determining that the engine is not being operated, operating, by the controller, an electric air compressor;

in response to determining that the engine is being operating, operating an engine driven air compressor;

determining, by the controller, whether an operation completion air pressure has been reached by comparing the air pressure in the air tank with the operation completion air pressure; and in response to the air pressure in the air tank reaching the operation completion pressure, terminating operation of either the engine driven air compressor or the electric driven air compressor, depending upon which was previously operating, wherein operating the electric air compressor provides the pressurized air, in which moisture and impurities are removed and pressure of which is adjusted by an air pressure unit (APU), and thus increases the air pressure in the air tank, and wherein operating the engine driven air compressor provides the pressurized air, in which moisture and impurities are removed and pressure of which is adjusted by the APU, and thus increases air pressure in the air tank.

2. The method for generating air pressure in an eco-friendly vehicle of claim 1, further comprising:

determining whether or not the electric air compressor is operating normally in response to determining that the engine is not operating, wherein the electric air compressor is operated when the electric air compressor is operating normally, and wherein the engine driven air compressor is operated when the electric air compressor is operating abnormally.

3. The method for generating air pressure in an eco-friendly vehicle of claim 2, further comprising:

determining whether or not a high voltage system of the vehicle is operating normally in response to determining that the electric air compressor is operating normally, wherein the electric air compressor is operated when the high voltage system is operating normally, and wherein the engine driven air compressor is operated when the high voltage system is operating abnormally.

4. The method for generating air pressure in an eco-friendly vehicle of claim 3, further comprising:

determining whether or not a low voltage system of the vehicle is operating normally in response to determining that the high voltage system is operating normally, wherein the electric air compressor is operated when the low voltage system is operating normally, and wherein the engine driven air compressor is operated when the low voltage system is operating abnormally.

5. The method for generating air pressure in an eco-friendly vehicle of claim 1, wherein:

the operation of the engine driven air compressor or the electric air compressor is terminated when the air pressure in the air tank is equal to or greater than the operation completion air pressure; and returning to the determining whether or not the engine is being operated when the air pressure in the air tank is less than the operation completion air pressure.

6. The method for generating air pressure in an eco-friendly vehicle of claim 1, wherein the operation completion air pressure is higher than the operation start air pressure.

* * * * *